US006234878B1

(12) United States Patent
Moore

(10) Patent No.: US 6,234,878 B1
(45) Date of Patent: May 22, 2001

(54) ENDPOINT DETECTION APPARATUS, PLANARIZING MACHINES WITH ENDPOINTING APPARATUS, AND ENDPOINTING METHODS FOR MECHANICAL OR CHEMICAL-MECHANICAL PLANARIZATION OF MICROELECTRONIC SUBSTRATE ASSEMBLIES

(75) Inventor: Scott E. Moore, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/625,776

(22) Filed: Jul. 26, 2000

Related U.S. Application Data

(62) Division of application No. 09/386,645, filed on Aug. 31, 1999.

(51) Int. Cl.[7] ..... B24B 1/00
(52) U.S. Cl. ..... 451/41; 451/8
(58) Field of Search ..... 451/6, 8, 9, 296, 451/41

(56) References Cited

U.S. PATENT DOCUMENTS 5,036,015 * 7/1991 Sandhu et al. ..... 437/8
5,639,388 * 6/1997 Kimura et al. ..... 216/84

* cited by examiner

*Primary Examiner*—Timothy V. Eley
*Assistant Examiner*—Dung Van Nguyen
(74) *Attorney, Agent, or Firm*—Dorsey & Whitney LLP

(57) ABSTRACT

Endpointing devices, planarizing machines with endpointing devices, and methods for endpointing mechanical and/or chemical-mechanical planarization of microelectronic substrate assemblies. One endpointing apparatus in accordance with the invention includes a primary support member for supporting either a polishing pad or a substrate assembly, and a secondary support member coupled to the primary support member. The primary support member is movable with respect to the secondary support member in a lateral motion at least generally parallel to the planarizing plane in correspondence to the drag forces between the substrate assembly and the polishing pad. The endpointing apparatus also includes a force detector attached to at least one of the primary and secondary support members at a force detector site that can have a contact surface transverse to the planarizing plane. The force detector measures lateral forces between the primary support member and the secondary support member in response to drag forces between the substrate assembly and the polishing pad. In operation, the endpoint of CMP processing is detected when the measure lateral force is equal to a predetermined endpoint force for a particular CMP application.

4 Claims, 11 Drawing Sheets

ENDPOINT DETECTION APPARATUS, PLANARIZING MACHINES WITH ENDPOINTING APPARATUS, AND ENDPOINTING METHODS FOR MECHANICAL OR CHEMICAL-MECHANICAL PLANARIZATION OF MICROELECTRONIC SUBSTRATE ASSEMBLIES

CROSS-REFERENCE TO RELATED APPLICATION

This application is a divisional of pending U.S. patent application Ser. No. 09/386,645, filed Aug. 31, 1999.

TECHNICAL FIELD

The present invention relates to methods and apparatuses for planarizing microelectronic substrate assemblies and, more particularly, to apparatuses and methods for endpointing mechanical and/or chemical-mechanical planarization of semiconductor wafers, field emission displays and other microelectronic substrate assemblies.

BACKGROUND OF THE INVENTION

Mechanical and chemical-mechanical planarizing processes (collectively "CMP") are used in the manufacturing of electronic devices for forming a flat surface on semiconductor wafers, field emission displays and many other microelectronic substrate assemblies. CMP processes generally remove material from a substrate assembly to create a highly planar surface at a precise elevation in the layers of material on the substrate assembly.

FIG. 1 is a schematic isometric view of a web-format planarizing machine 10 for planarizing a microelectronic substrate assembly 12. The planarizing machine 10 has a table 11 with a rigid panel or plate to provide a flat, solid support surface 13 for supporting a portion of a web-format planarizing pad 40 in a planarizing zone "A." The planarizing machine 10 also has a pad advancing mechanism including a plurality of rollers to guide, position, and hold the web-format pad 40 over the support surface 13. The pad advancing mechanism generally includes a supply roller 20, first and second idler rollers 21*a* and 21*b*, first and second guide rollers 22*a* and 22*b*, and a take-up roller 23. As explained below, a motor (not shown) drives the take-up roller 23 to advance the pad 40 across the support surface 13 along a travel axis T—T. The motor can also drive the supply roller 20. The first idler roller 21*a* and the first guide roller 22*a* press an operative portion of the pad against the support surface 13 to hold the pad 40 stationary during operation.

The planarizing machine 10 also has a carrier assembly 30 to translate the substrate assembly 12 across the pad 40. In one embodiment, the carrier assembly 30 has a head 32 to pick up, hold and release the substrate assembly 12 at appropriate stages of the planarizing process. The carrier assembly 30 also has a support gantry 34 and a drive assembly 35 that can move along the gantry 34. The drive assembly 35 has an actuator 36, a drive shaft 37 coupled to the actuator 36, and an arm 38 projecting from the drive shaft 37. The arm 38 carries the head 32 via another shaft 39. The actuator 36 orbits the head 32 about an axis B—B to move the substrate assembly 12 across the pad 40.

The polishing pad 40 may be a non-abrasive polymeric pad (e.g., polyurethane), or it may be a fixed-abrasive polishing pad in which abrasive particles are fixedly dispersed in a resin or another type of suspension medium. A planarizing fluid 50 flows from a plurality of nozzles 49 during planarization of the substrate assembly 12. The planarizing fluid 50 may be a conventional CMP slurry with abrasive particles and chemicals that etch and/or oxidize the surface of the substrate assembly 12, or the planarizing fluid 50 may be a "clean" non-abrasive planarizing solution without abrasive particles. In most CMP applications, abrasive slurries with abrasive particles are used on non-abrasive polishing pads, and non-abrasive clean solutions without abrasive particles are used on fixed-abrasive polishing pads.

In the operation of the planarizing machine 10, the pad 40 moves across the support surface 13 along the. pad travel path T—T either during or between planarizing cycles to change the particular portion of the polishing pad 40 in the planarizing zone A. For example, the supply and take-up rollers 20 and 23 can drive the polishing pad 40 between planarizing cycles such that a point P moves incrementally across the support surface 13 to a number of intermediate locations $I_1$, $I_2$, etc. Alternatively, the rollers 20 and 23 may drive the polishing pad 40 between planarizing cycles such that the point P moves all the way across the support surface 13 to completely remove a used portion of the pad 40 from the planarizing zone A. The rollers may also continuously drive the polishing pad 40 at a slow rate during a planarizing cycle such that the point P moves continuously across the support surface 13. Thus, the polishing pad 40 should be free to move axially over the length of the support surface 13 along the pad travel path T—T.

CMP processes should consistently and accurately produce a uniform, planar surface on substrate assemblies to enable circuit and device patterns to be formed with photolithography techniques. As the density of integrated circuits increases, it is often necessary to accurately focus the critical dimensions of the photo-patterns to within a tolerance of approximately 0.1 pm. Focusing photo-patterns to such small tolerances, however, is difficult when the planarized surfaces of substrate assemblies are not uniformly planar. Thus, to be effective, CMP processes should create highly uniform, planar surfaces on substrate assemblies.

In the highly competitive semiconductor industry, it is also desirable to maximize the throughput of CMP processing by producing a planar surface on a substrate assembly as quickly as possible. The throughput of CMP processing is a function of several factors, one of which is the ability to accurately stop CMP processing at a desired endpoint. In a typical CMP process, the desired endpoint is reached when the surface of the substrate assembly is planar and/or when enough material has been removed from the substrate assembly to form discrete components on the substrate assembly (e.g., shallow trench isolation areas, contacts, damascene lines, etc.). Accurately stopping CMP processing at a desired endpoint is important for maintaining a high throughput because the substrate assembly may need to be re-polished if it is "under-planarized," or too much material can be removed from the substrate assembly if it is "over-polished." For example, over-polishing can cause "dishing" in shallow-trench isolation structures or completely destroy a section of the substrate assembly. Thus, it is highly desirable to stop CMP processing at the desired endpoint.

One method for determining the endpoint of CMP processing is described in U.S. Pat. No. 5,036,015 issued to Sandhu ("Sandhu"), which is herein incorporated by reference. Sandhu discloses detecting the planar endpoint by sensing a change in friction between a wafer and the polishing medium. Such a change of friction may be produced by a different coefficient of friction at the wafer surface as one material (e.g., an oxide) is removed from the wafer to expose another material (e.g., a nitride). In addition to the different coefficients of friction caused by a change of material at the substrate surface, the friction between the wafer and the planarizing medium generally increases during CMP processing because more surface area of the substrate contacts the polishing pad as the substrate becomes more planar. Sandhu discloses detecting the change in friction by measuring the change in electrical current through the platen drive motor and/or the drive motor for the substrate holder.

Although Sandhu discloses a viable process for endpointing CMP processing, the change in electrical current through the platen and/or drive motor may not accurately indicate the endpoint of a substrate assembly. For example, the friction between the substrate assembly and the planarizing medium generally increases substantially linearly, and thus the change in the motor current at the endpoint may not be sufficient to provide a definite signal identifying that the endpoint has been reached. Moreover, friction losses and other power losses in the motors, gearboxes or other components may also change the current draw through the motors. The change in current through the drive motors, therefore, may not accurately reflect the drag force between the wafer and the polishing pad because the drag force is not the only factor that influences the current draw. Thus, it would be desirable to develop an apparatus and method for more accurately endpointing planarization of microelectronic substrate assemblies.

SUMMARY OF THE INVENTION

The present invention is directed toward endpointing apparatuses, planarizing machines with endpointing apparatuses, and methods for endpointing mechanical and/or chemical-mechanical planarization of microelectronic substrate assemblies. One endpointing apparatus in accordance with the invention includes a primary support member for supporting either a polishing pad or a substrate assembly, and a secondary support member coupled to the primary support member. The primary support member is movable with respect to the secondary support member in a lateral motion at least generally parallel to a planarizing plane in correspondence to drag forces between the substrate assembly and the polishing pad. The primary support member, for example, can rest on a bearing assembly that provides for relatively frictionless lateral displacement between the primary and secondary support members. The endpointing apparatus also includes a force detector attached to the primary support member and/or the secondary support member at a force detector site having a contact surface transverse to the planarizing plane. The force detector measures lateral forces between the primary support member and the secondary support member in response to drag forces between the substrate assembly and the polishing pad. The primary support member can be held with respect to the secondary support member by dead stops and force detectors, or by posts attached to both the primary and secondary support members. In either case, the force detector senses lateral forces imparted to the primary support member by the substrate assembly during planarization. In operation, the endpoint of CMP processing is detected when the measured lateral force is equal to a predetermined endpoint force for a particular CMP application.

In one planarizing machine in accordance with the invention, the primary support member is a moveable primary plate or platen under the polishing pad, and the secondary support member is a base or sub-platen under the primary plate. The planarizing machine can also include a carrier assembly having a head configured to hold a substrate assembly against the planarizing surface and a drive system to move the head. At least one of the polishing pad or the head moves in a lateral motion at least generally parallel to the planarizing plane. The base can have a base surface facing toward the polishing pad and a first stop surface projecting from the base surface transverse to the planarizing plane. The primary plate can have a bearing surface facing the backside of the polishing pad to support at least a portion of the polishing pad in a planarizing zone, and the primary plate can also have a first contact surface adjacent to the first stop surface on the base. The primary plate is moveable with respect to the base in a lateral motion corresponding to the drag forces between the substrate assembly and the polishing pad. The planarizing machine can further include at least a first force detector contacting the first stop surface and the first contact surface at a load site. The force detector is configured to sense lateral forces between the base and the primary plate corresponding to the lateral drag forces between the substrate assembly and the polishing pad.

The present invention also includes several additional embodiments in which the force detector is attached at a load site to at least one of the carrier head or the table. Several of these embodiments accordingly do not use a table with primary and secondary support members. The force detector provides a signal indicative of the lateral drag forces between the substrate assembly and the polishing pad.

DETAILED DESCRIPTION OF THE INVENTION

The present invention relates to endpointing devices, planarizing machines including endpointing devices, and methods for predicting the endpoint of planarizing processes in mechanical or chemical-mechanical planarization of semiconductor wafers, field emission displays and other microelectronic substrate assemblies. Many specific details of the invention are described below with reference to web-format and rotary planarizing machines to provide a thorough understanding of such embodiments. The present invention, however, may have additional embodiments or can be practiced without several of the details described in the following description.

Figure 1:
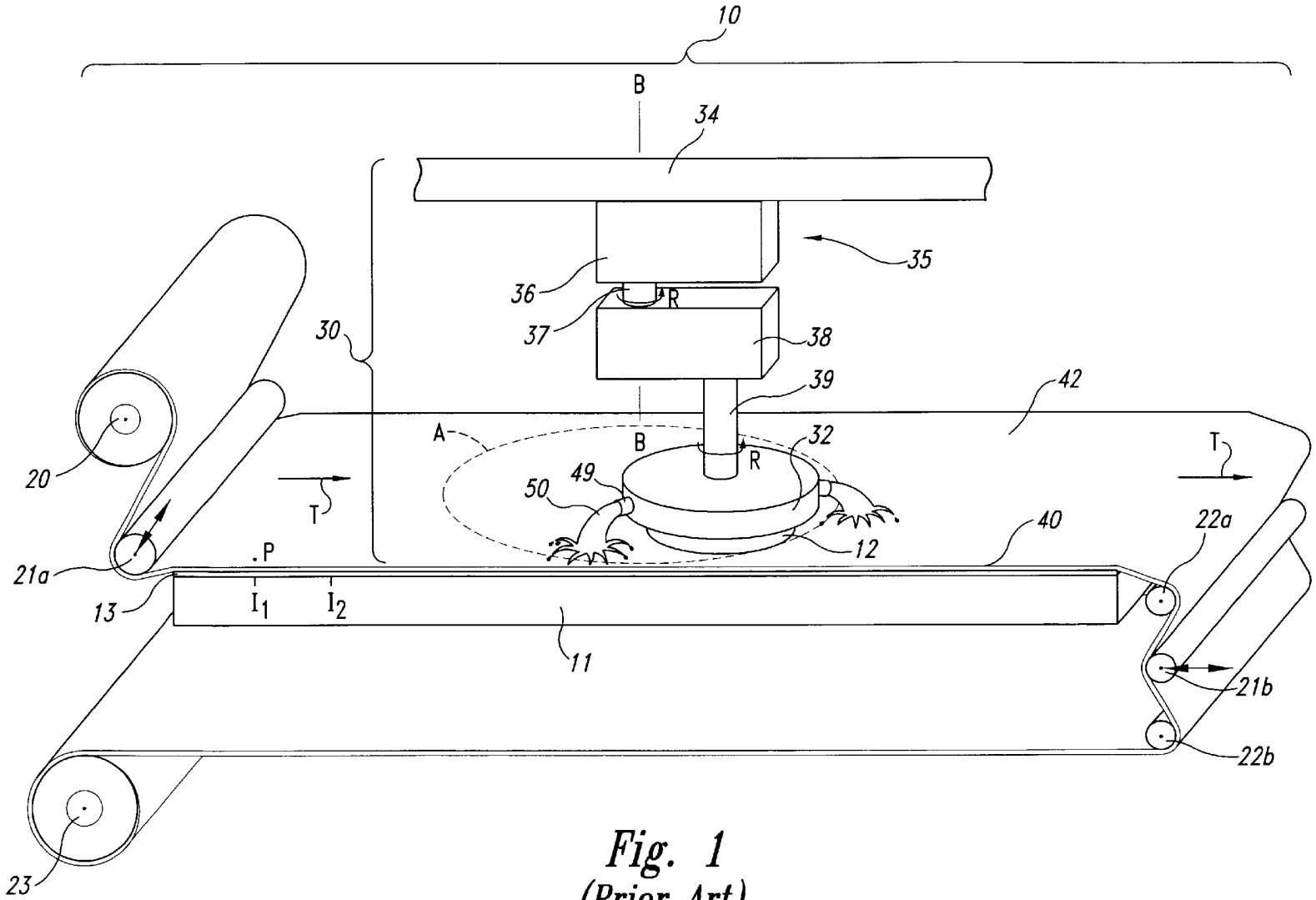
Fig. 1 (Prior Art)
FIG. 1 is an isometric view of a web-format planarizing machine in accordance with the prior art.
Figure 2:
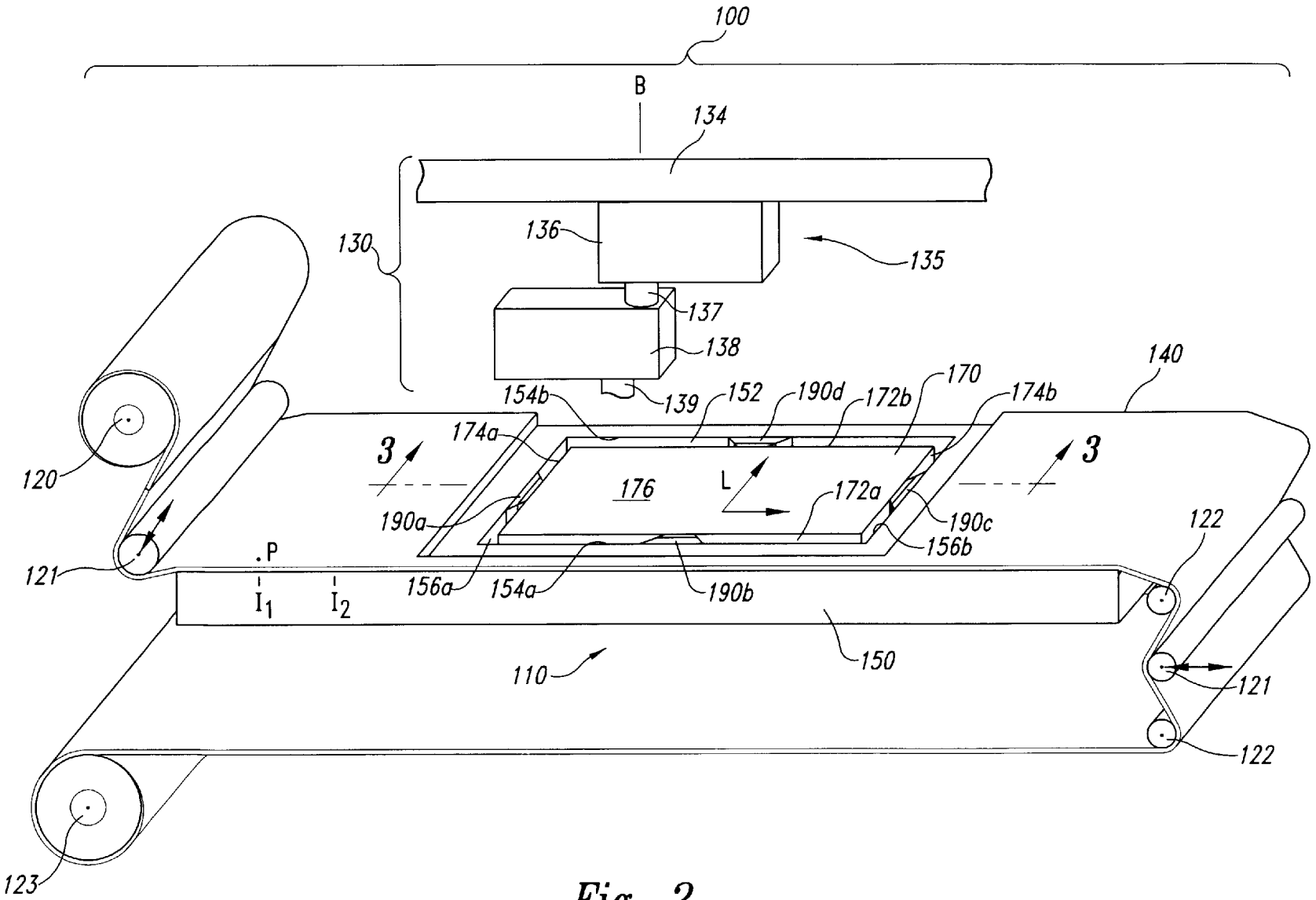
FIG. 2 is a schematic isometric view of a web-format planarizing machine having a cut-away portion illustrating an endpointing apparatus in accordance with an embodiment of the invention.

FIG. 2 is a schematic isometric view of a web-format planarizing machine 100 for planarizing a microelectronic substrate assembly 12 in accordance with an embodiment of the invention. The planarizing machine 100 includes a table 110, a carrier assembly 130 over the table 110, and a polishing pad 140 on the table 110. The carrier assembly 130 and the polishing pad 140 can be substantially the same as those described above with reference to FIG. 1. The polishing pad 140 is accordingly coupled to a pad-advancing mechanism having a plurality of rollers 120, 121, 122 and 123. The pad-advancing mechanism can also be the same as that described above with reference to FIG. 1.

The planarizing machine 100 also includes an endpointing apparatus that measures the drag force between the substrate assembly 12 and the polishing pad 140 during planarization. The endpointing apparatus generally includes a secondary support member defined by a sub-platen 150, a primary support member defined by a platen 170, and at least one force detector 190 between the sub-platen 150 and the platen 170. The platen 170 and the sub-platen 150 are generally separate components of the table 110. The polishing pad 140 is releasably coupled to the platen 170 so that drag forces between the substrate assembly 12 and the pad 140 exert lateral forces against the platen 170. The platen 170 can move laterally with respect to sub-platen 150 in correspondence to drag forces between the substrate assembly 12 and the polishing pad 140, and the force detector 190 can detect the lateral forces that the platen 170 exerts against the sub-platen 150. In general, the endpoint of a planarizing cycle is detected when the measured lateral force between the sub-platen 150 and the platen 170 reaches a predetermined endpoint force.

Figure 3:
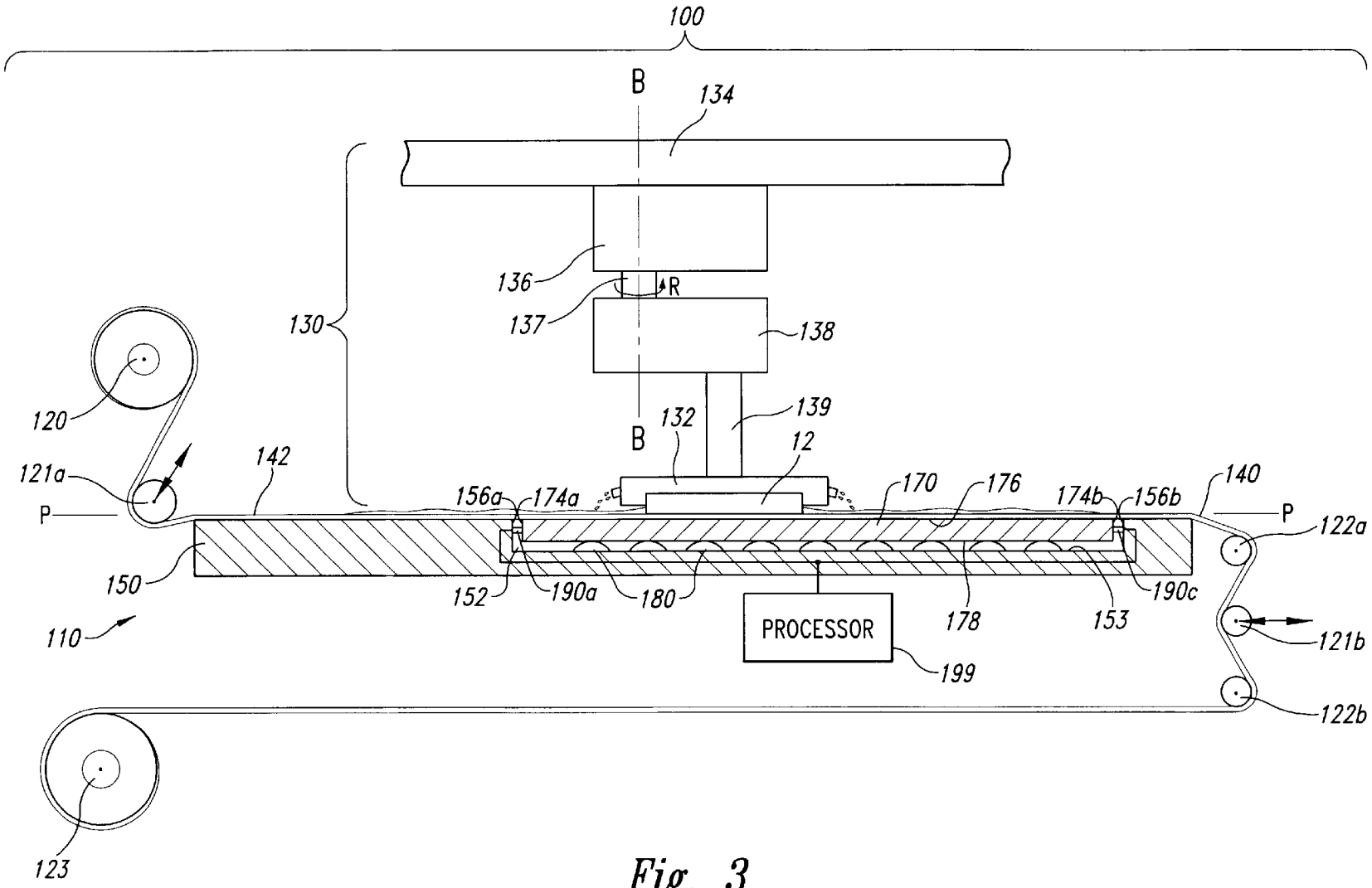
FIG. 3 is a schematic cross-sectional view of the planarizing machine in FIG. 2 along line 3—3.

FIG. 3 is a schematic cross-sectional view of the planarizing machine 100 illustrating the endpointing apparatus in greater detail. Referring to FIGS. 2 and 3 together, the sub-platen 150 can be a base supporting the platen 170. The sub-platen 150 has a recess 152 defined by a base surface 153 and a plurality of walls (identified by reference numbers 154*a*, 154*b*, 156*a* and 156*b*) projecting upwardly from the base surface 153 transversely with respect to a planarizing plane P—P (FIG. 3). For the purposes of the present disclosure, the term "transverse" means any non-parallel arrangement and is not limited to a perpendicular arrangement. The walls can include a first side-wall 154*a*, a second side-wall 154*b* opposite the first side-wall 154*a*, a first end-wall 156*a* at one end of the side-walls 154*a* and 154*b*, and a second end-wall 156*b* at the other end of the side-walls 154*a* and 154*b*. The walls can be configured in a rectilinear pattern or other suitable patterns to receive the platen 170.

The platen 170 is positioned in the recess 152 of the sub-platen 150. The platen 170 can be a plate having a first side-face 172*a*, a second sideface 172*b* opposite the first side-face 172*a*, a first end-face 174*a* between one end of the side-faces 172*a* and 172*b*, and a second end-face 174*b* between the other end of the side-faces 172*a* and 172b. In the embodiment shown in FIG. 3, the first side-face 172*a* is adjacent to the first side-wall 154*a*, the second side-face 172*b* is adjacent to the second side-wall 154*b*, the first end-face 174*a* is adjacent to the first end-wall 156*a*, and the second end-face 174*b* is adjacent to the second end-wall 156b. The platen 170 also includes a bearing surface 176 facing the backside of the polishing pad 140 to support at least a portion of the polishing pad 140 in a planarizing zone under the head 132, and the platen 170 includes a back surface 178 facing the base surface 153 of the sub-platen 150. The polishing pad 140 is coupled to the bearing surface 176 during planarization so that the pad transmits lateral forces to the platen 170. Suitable devices and methods for coupling the polishing pad 140 to the bearing surface 176 are disclosed in U.S. patent application Ser. Nos. 09/285,319 filed on Apr. 2, 1999, and 09/181,578 filed on Oct. 28, 1998, both of which are herein incorporated by reference.

The platen 170 can move with respect to the sub-platen 150 in a lateral motion L (FIG. 2) at least generally parallel to a planarizing plane P—P (FIG. 3). In this embodiment, the endpointing apparatus also includes a bearing mechanism 180 (FIG. 3) to reduce the friction between the base surface 153 of the sub-platen 150 and the back surface 178 of the platen 170. The bearing assembly 180 can be a roller mechanism having a plurality of rollers attached to either the sub-platen 150 or the platen 170 to allow the platen 170 to freely roll across the sub-platen 150. The bearing assembly 180 can also be a low-friction coating or lubricant between the base surface 153 and the back surface 178, or a flexible bladder (not shown) between the sub-platen 150 and the platen 170. In still another embodiment, the bearing assembly 180 can be a frictionless device having a number of air bearings defined by air holes through the sub-platen 150 that are connected to a pressurized air source that provides a continuous layer of air between the sub-platen 150 and the platen 170. In still another embodiment, the bearing assembly 180 can be a magnetic device including magnetic bearings that prevent the back surface 178 from contacting the base surface 153 by positioning magnetic fields of a like polarity adjacent to one another. In operation, the bearing assembly 180 frictionally isolates the platen 170 from the sub-platen 150 so that the drag forces between the substrate assembly 12 and the pad 140 drive the platen 170 laterally with respect to the sub-platen 150 without substantial friction losses.

The force detectors 190 (identified by reference numbers 190*a*-190*d*) can be positioned between the walls of the recess 152 in the sub-platen 150 and the faces of the platen 170. Each force detector 190 can be a contact sensor that contacts both the sub-platen 150 and the platen 170 to sense the lateral forces exerted by the platen 170 against the sub-platen 150 in correlation to the lateral forces exerted by the substrate assembly 12 against the polishing pad 140 during planarization. Suitable contact force detectors are strain gauges, piezoelectric elements or other transducers that generate signals corresponding to the force exerted by the platen 170 against the sub-platen 150. The force detectors 190 can be other sensors that generate electrical signals corresponding to the lateral forces or displacement between the sub-platen 150 and the platen 170. For example, in other embodiments in which the force detectors 190 do not contact the platen 170 and the sub-platen 150 does not have dead stops so that the platen 170 can move relative to the sub-platen 150, the force detectors 190 can be lasers, accelerometers, capacitance displacement sensors, linear variable differential transformers or other displacement sensors.

In the particular embodiment of the planarizing machine 100 illustrated in FIGS. 2 and 3, four force detectors are configured along two orthogonal axes. In other embodiments, the planarizing machine 100 can have only one force detector positioned along one axis, or two force detectors positioned along two orthogonal axes, or any number of force detectors positioned between the walls of the sub-platen 150 and the faces of the platen 170. For example, in an embodiment having two force detectors 190 positioned along orthogonal axes, a first force detector 190a can contact the first end-wall 156*a* and the first end-face 174*a* at a first force detector site, a second force detector 190*b* can contact the first side-wall 154*a* and the first side-face 172*a* at a second force detector site, and dead stops can be substituted for the force detectors 190*c* and 190*d*. The first end-wall 156*a* and the first side-wall 154*a* of the sub-platen 150 accordingly define first and second stop surfaces, and the first end-face 174*a* and the first side-face 172*a* of the platen 170 accordingly define first and second contact surfaces. In still another embodiment, the first and second force detectors 190*a* and 190*b* can be positioned as explained above, and the dead stops or force detectors 190*c* and 190*d* can be eliminated by sizing the platen 170 such that the second end-face 174*b* abuts the second end-wall 156*b* and the second side-face 172*b* abuts the second side-wall 154*b*.

The embodiment of the endpointing apparatus described above with reference to the planarizing machine 100 operates by measuring the drag force between the substrate assembly 12 and the polishing pad 140, and comparing the measured drag force with a predetermined endpoint force. In operation, the carrier assembly 130 presses the substrate assembly 12 against a planarizing surface 142 of the polishing pad 140, and the drive system 135 moves the head 132 to translate the substrate assembly 12 across the planarizing surface 142 in a lateral motion at least generally parallel to the planarizing plane P—P. The lateral drag forces generated by the friction between the substrate assembly 12 and the planarizing surface 142 are transmitted to the platen 170 via the polishing pad 140. The lateral drag forces drive the platen 170 against the force detectors 190, which generate corresponding electrical signals. The electrical signals from the force detectors 190 are transmitted to a processor 199 that converts the electrical signals into data that can be analyzed.

Figure 4:
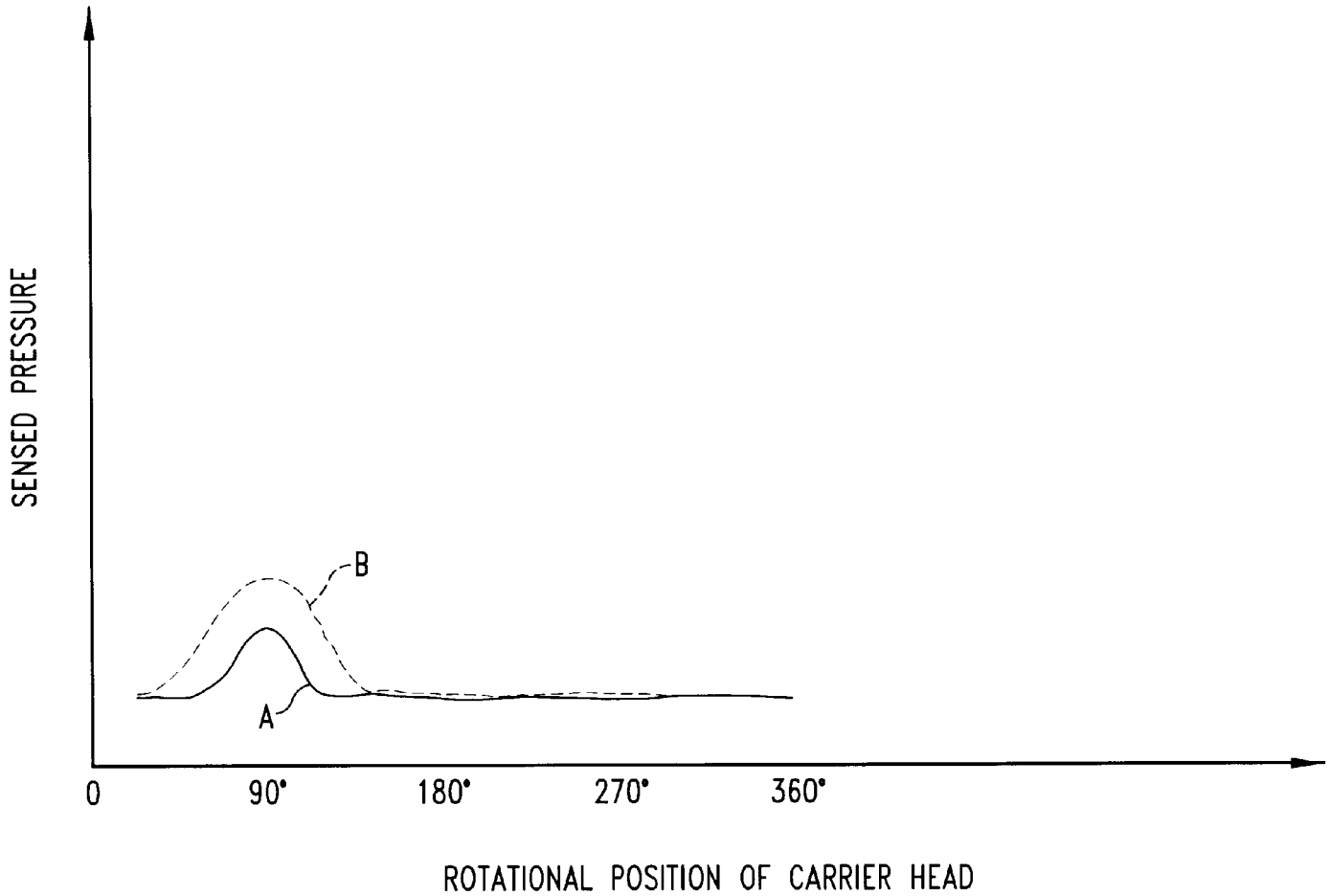
FIG. 4 is a graph illustrating the sensed pressure as a function of the rotational position of the carrier head.

FIG. 4, for example, is a graph illustrating the lateral forces sensed by one of the force detectors 190 during planarization. In general, the force detector 190 senses the increase in lateral force that the platen 170 exerts against the sub-platen 150 from a level A to a level B as the substrate assembly 12 is planarized. The endpoint of the substrate assembly 12 can be detected by empirically determining the typical load exerted by the platen 170 against the sub-platen 150 at the endpoint of the planarizing cycle of a particular application assembly.

The planarizing machines described above with reference to FIGS. 2 and 3 are expected to enhance the accuracy of endpointing CMP processing because they isolate a drag force parameter that is not influenced by energy losses unrelated to drag force at the pad/substrate interface. In contrast to conventional planarizing processes that endpoint CMP processing using the current of the drive motors, several embodiments of the planarizing machines described above with reference to FIGS. 2 and 3 measure the drag force between the substrate assembly and the polishing pad by isolating the displacement or the internal forces between either a platen and sub-platen, or a carrier head and a drive shaft. The isolated drag force parameter provides a much more accurate indication of the actual drag force at the pad/substrate interface than measuring motor current because energy losses and other factors associated with moving the carrier head or the polishing pad do not influence or otherwise overshadow the changes in drag force between the pad and the substrate assembly. The endpointing apparatuses and monitoring systems described above with reference to FIGS. 2 and 3, therefore, are expected to enhance the accuracy of detecting the endpoint in CMP processing.

The planarizing machine 100 is also expected to enhance the accuracy of endpointing CMP processing because the bearing assembly 180 frictionally isolates the back surface 178 of the platen 170 from the base surface 153 of the sub-platen 150. The bearing assembly 180 accordingly reduces friction losses between the sub-platen 150 and the platen 170 so that the lateral movement of the platen 170 against the force detectors 190 is influenced primarily by the drag forces between the substrate assembly 12 and the polishing pad 140. The endpointing apparatus of the planarizing machine 100 accordingly avoids measuring the drag force in a manner in which power and friction losses in the gears and electric drive motors for the platen and carrier assembly can influence the measured drag force between the substrate assembly and the polishing pad. The planarizing machine 100, therefore, is expected to enhance the accuracy of detecting the endpoint of CMP processing.

Figure 5:
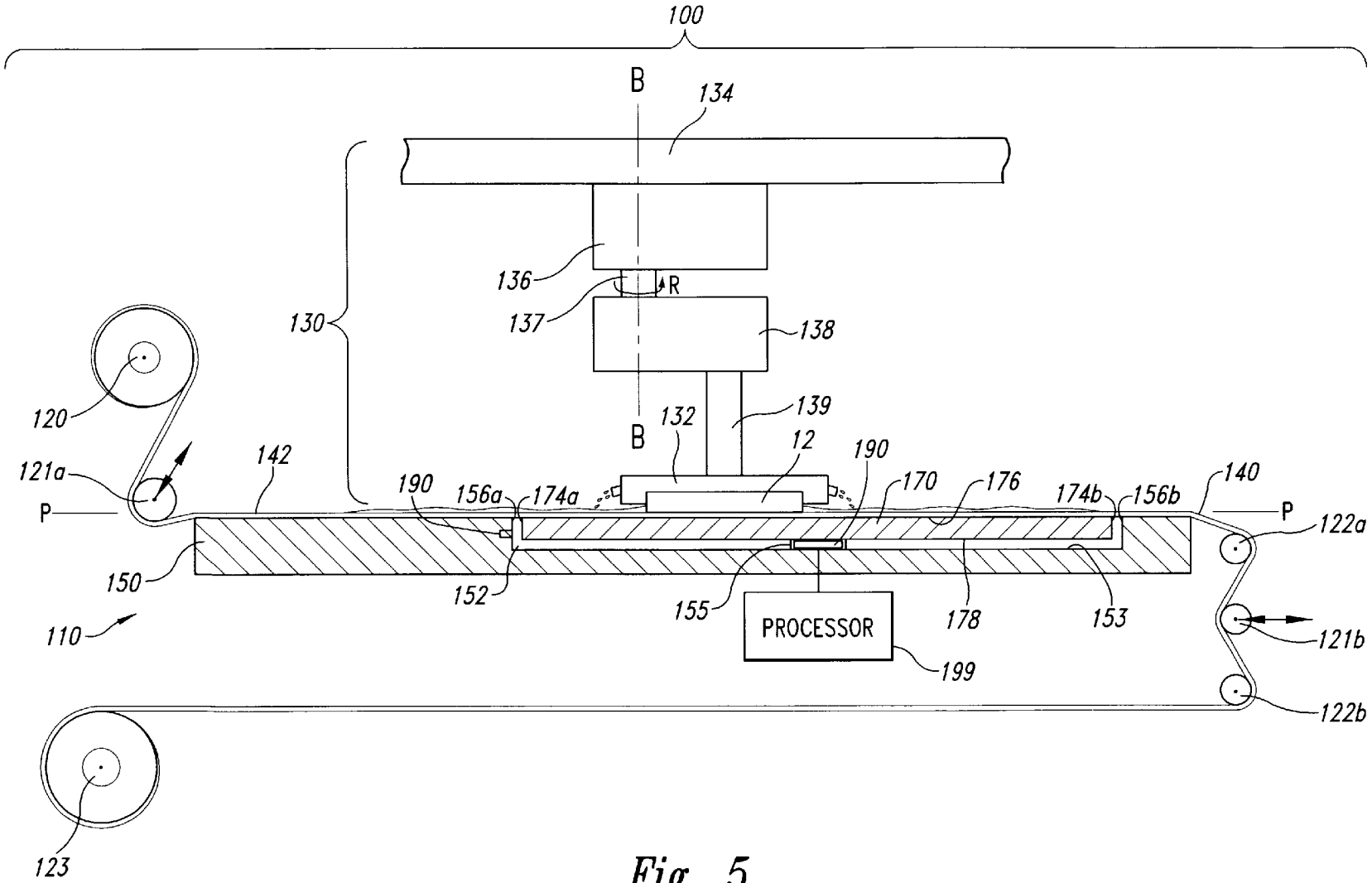
FIG. 5 is a schematic cross-sectional view of the planarizing machine in accordance with another embodiment of the invention.

FIG. 5 is a schematic cross-sectional view of the planarizing machine 100 in accordance with another embodiment of the invention. In this embodiment, the sub-platen 150 has a post 155 projecting upwardly from the base surface 153, and the platen 170 is fixedly attached to the post 155. The walls 172/174 of the platen 170 do not contact either the faces 154/156 of the sub-platen 150, any dead stops, or other devices that inhibit the platen 170 from moving with respect to the sub-platen 150. The movement of the substrate assembly 12 across the polishing pad 140 accordingly displaces the platen 170 relative to the sub-platen 150 and generates torsional forces in the post 155 that are expected to be proportionate to the drag force between the substrate assembly 12 and the polishing pad 140. The force detector 190 can be a strain gauge attached to the post 155 to measure the torsional displacement of the post 155. The force detector 190 senses the change in the torsional forces exerted on the platen 170 and sends a signal to the processor 199. In another embodiment, the force detector 190 can be a displacement sensor at one of the walls (e.g., end-wall 156*a*) of the recess 152 in the sub-platen 150. Thus, this embodiment is also expected to accurately detect the endpoint of the planarizing process.

Figure 6:
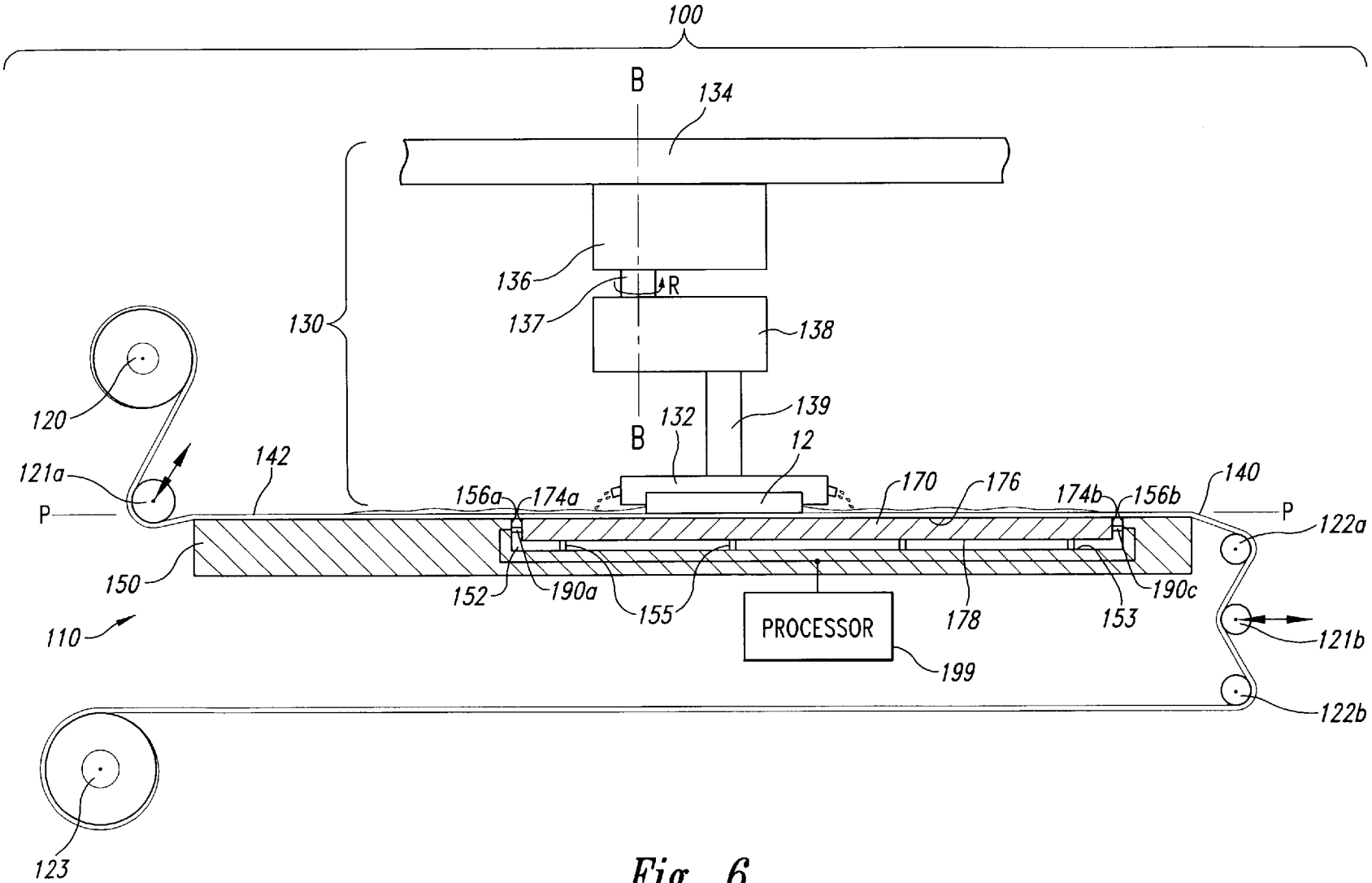
FIG. 6 is a schematic cross-sectional view of the planarizing machine in accordance with still another embodiment of the invention.

FIG. 6 is a schematic cross-sectional view of the planarizing machine 100 in accordance with another embodiment of the invention in which a number of posts 155 attach the platen 170 to the sub-platen 150. The platen 170 can also move laterally with respect to the sub-platen 150. The posts 155 can be threaded studs having a diameter of approximately 1.0 inch and a length of 3.0 inches made from metal, high density polymers or other suitable materials. The posts 155 of this embodiment accordingly do not frictionally isolate the platen 170 from the sub-platen 150, but rather they deflect through a small displacement to control the motion between the platen 170 and the sub-platen 150 in correspondence to the drag forces between the substrate assembly 12 and the polishing pad 140. The force detectors 190 accordingly measure the displacement between the platen 170 and the sub-platen 150 to determine the drag forces between the substrate assembly 12 and the polishing pad 140.

Figure 7:
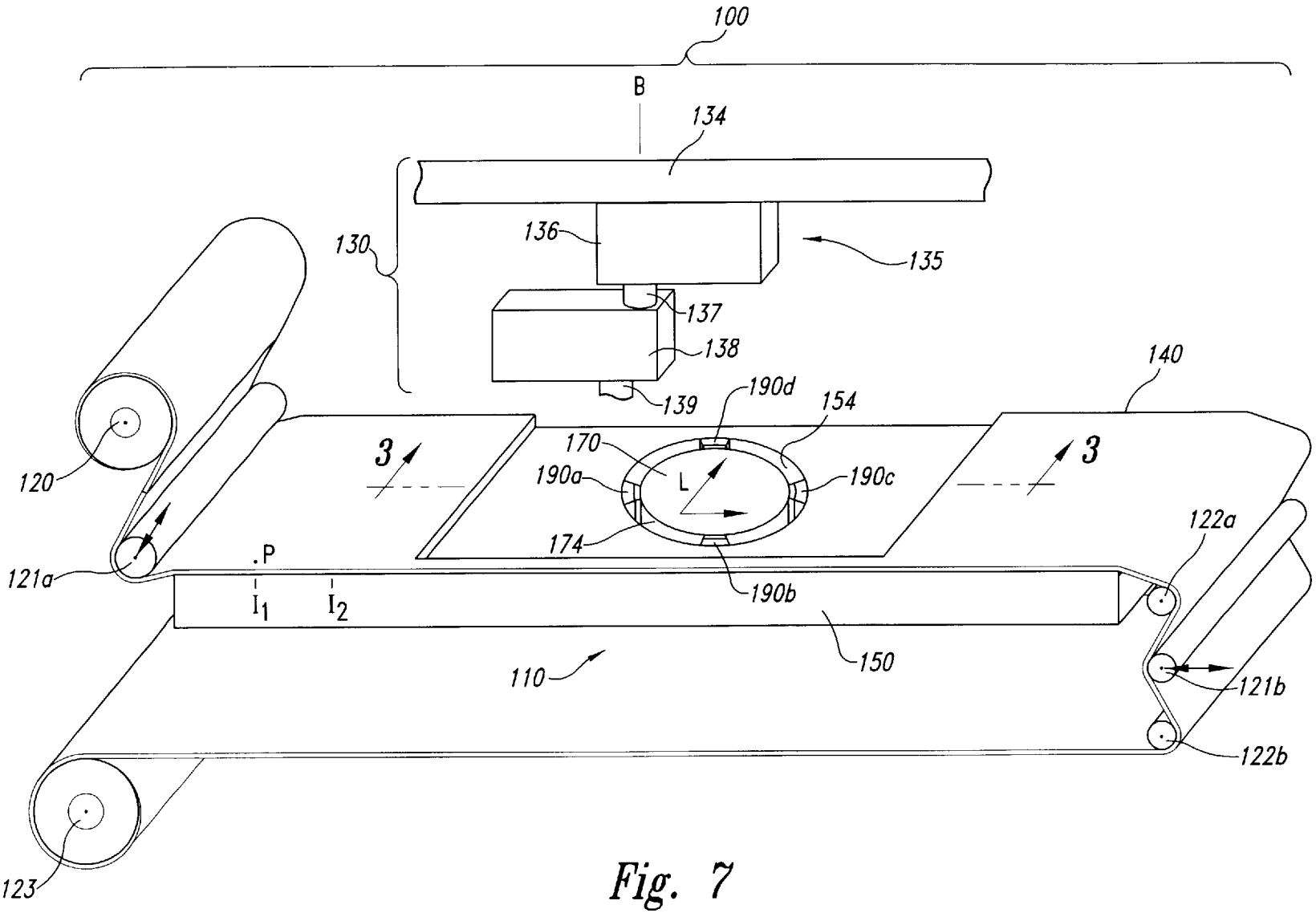
FIG. 7 is a schematic isometric view of a planarizing machine in accordance with another embodiment of the invention.

FIG. 7 is an schematic isometric view of a planarizing machine 100 in accordance with still another embodiment of the invention. In this embodiment, the planarizing machine 100 has a circular platen 170 and the recess 152 in the sub-platen 150 has a single circular wall 154. The platen 170 accordingly has a single, circular side-face 174. The platen 170 can be coupled to the sub-platen 150 by any of the bearings 180 or posts 155 described above with reference to FIGS. 2–6.

Figure 8:
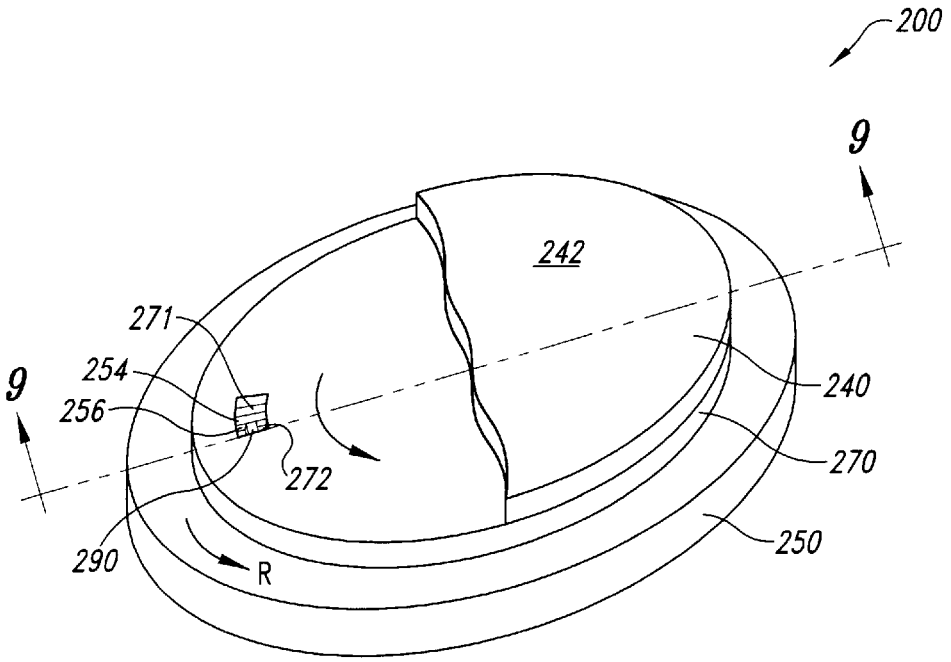
FIG. 8 is a schematic isometric view of a rotary planarizing machine with a cut-away section illustrating an endpointing apparatus in accordance with another embodiment of the invention.
Figure 9:
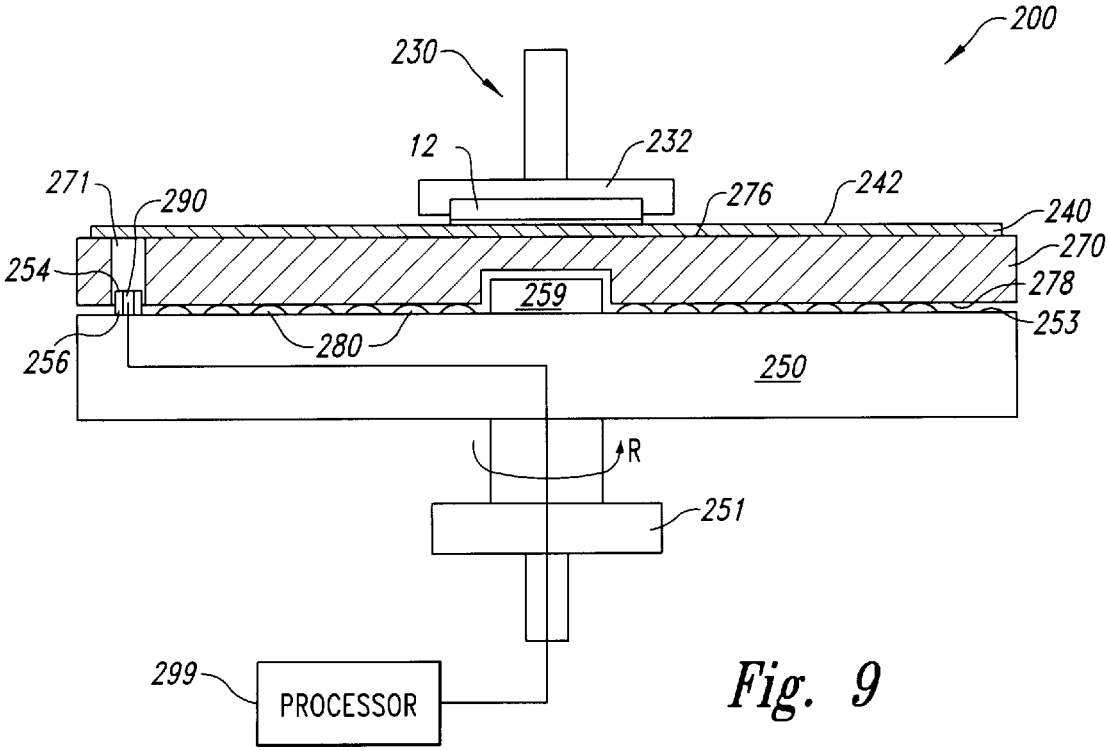
FIG. 9 is a schematic cross-sectional view of the planarizing machine of FIG. 8.

FIG. 8 is a schematic isometric view of a planarizing machine 200 in accordance with another embodiment of the invention, and FIG. 9 is a schematic cross-sectional view of the planarizing machine 200 taken along line 9—9. The planarizing machine 200 has a sub-platen 250 coupled to a rotary drive mechanism 251 to rotate the sub-platen 250 (arrow R), a platen 270 movably coupled to the sub-platen 250, and a polishing pad 240 attached to the platen 270. The sub-platen 250 has a base surface 253 facing the polishing pad 240 and a tab 254 projecting upwardly from the base surface 253. The tab 254 has a stop surface 256 facing in the direction of the rotation of the sub-platen 250. The platen 270 includes an opening 271 having a contact surface 272 facing the stop surface 256 of the tab 254. The planarizing machine 200 further includes a bearing assembly 280 that can be the same as the bearing assembly 180 described above with reference to FIG. 3. The planarizing machine 200 also includes a force detector 290 contacting the stop surface 256 of the tab 254 and the contact surface 272 of the platen 270.

The planarizing machine 200 is expected to enhance the accuracy of detecting the endpoint of planarizing a substrate assembly in rotary planarizing applications. In operation, a carrier assembly 230 (FIG. 9) moves a carrier head 232 to press the substrate assembly 12 against a planarizing surface 242 of the polishing pad 240. The rotary drive assembly 251 also rotates the sub-platen 250 causing the tab 254 to press the force detector 290 against the contact surface 272. The sub-platen 250 accordingly rotates the platen 270 in the direction R, but the drag force between the substrate assembly 12 and the polishing pad 240 resists rotation in the direction R. The bearing assembly 280 allows the drag forces between the substrate assembly 12 and the planarizing surface 242 to drive the contact surface 272 of the platen 270 against the force detector 290 in correlation to the drag forces. As the drag force increases between the substrate assembly 12 and the planarizing surface 242, the force detector 290 accordingly detects an increase in the lateral force that the platen 270 exerts against the tab 254. The force detector 290 is coupled to a processor 299 to convert the signals from the force detector 290 into data that can be analyzed to determine the endpoint of the planarizing process.

Figure 10:
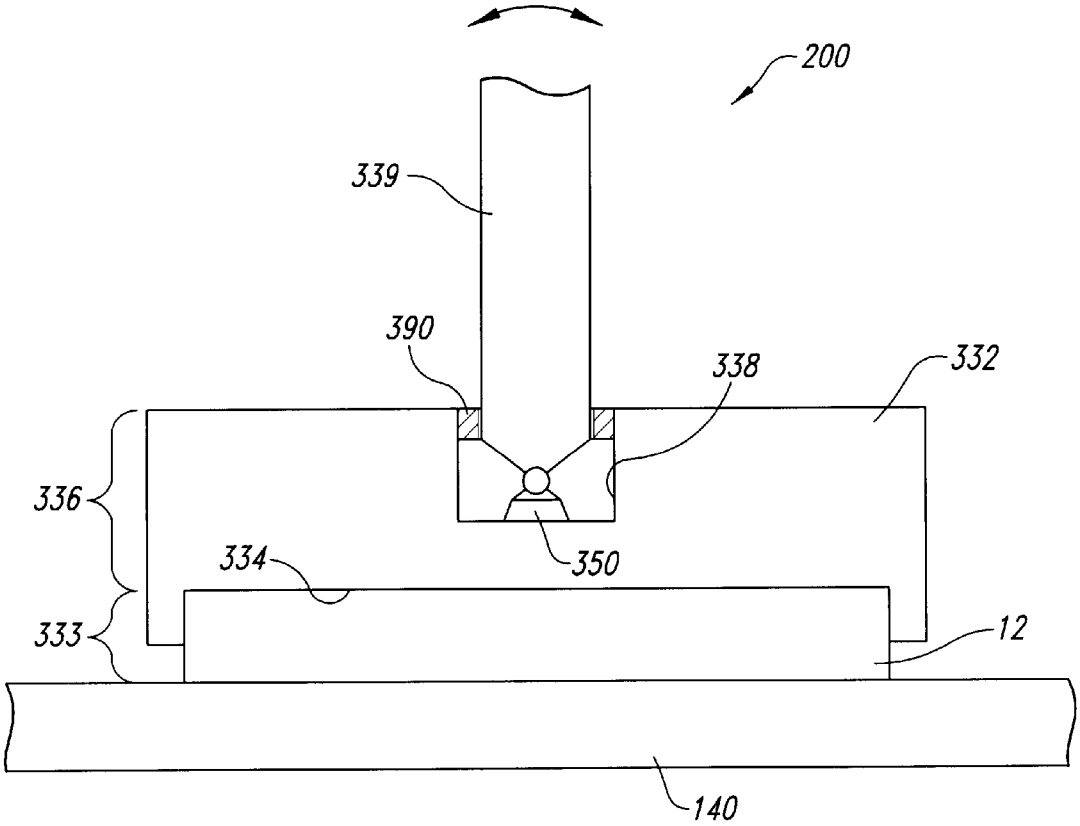
FIG. 10 is a schematic cross-sectional view of a substrate holder having an endpointing apparatus in accordance with yet another embodiment of the invention.

FIG. 10 is a schematic cross-sectional view of a carrier assembly 330 for a planarizing machine in accordance with another embodiment of the invention. The carrier assembly 330 can include a carrier head 332 having a lower portion 333 with a lower cavity 334 to receive a substrate assembly 12 and an upper portion 336 with an upper cavity 338. A pivoting joint 350 is attached to the head 332 in the cavity 338, and a drive-shaft 339 is pivotally attached to the joint 350. In this embodiment, the endpointing apparatus includes a primary support member defined by the head 332, a secondary support member defined by the drive-shaft 339, and a first contact surface defined by the side-wall of the upper cavity 338. In one embodiment, the joint 350 is a gimbal joint or other bearing assembly that allows universal pivoting between the head 332 and the shaft 339. The carrier head 332 also includes a force detector 390 attached to an interior wall of the cavity 338. The force detector 390, for example, can be an annular piezoelectric ring.

In operation, the drag forces between the substrate assembly 12 and the polishing pad 140 cause the shaft 339 to pivot about the joint 350 such that the lower end of the shaft 339 contacts the force detector 390. The force exerted by the driveshaft 339 against the force detector 390 will be proportional to the drag forces between the substrate assembly 12 and the polishing pad 140. Accordingly, the force detector 390 is coupled to a processor (not shown) to detect the endpoint of the planarizing process in a manner similar to that described above with respect to FIGS. 2–9.

Figure 11A:
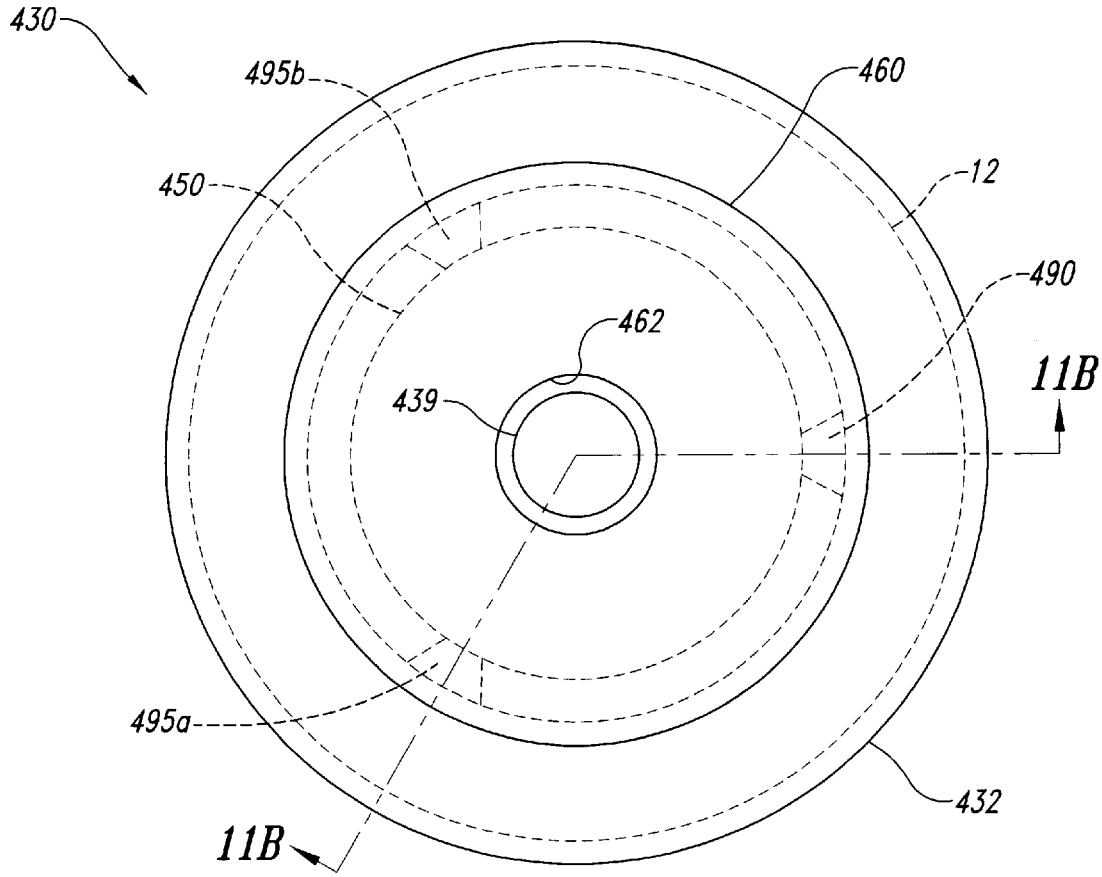
FIG. 11A is a plan view of a substrate holder having an endpointing apparatus in accordance with another embodiment of the invention.
Figure 11B:
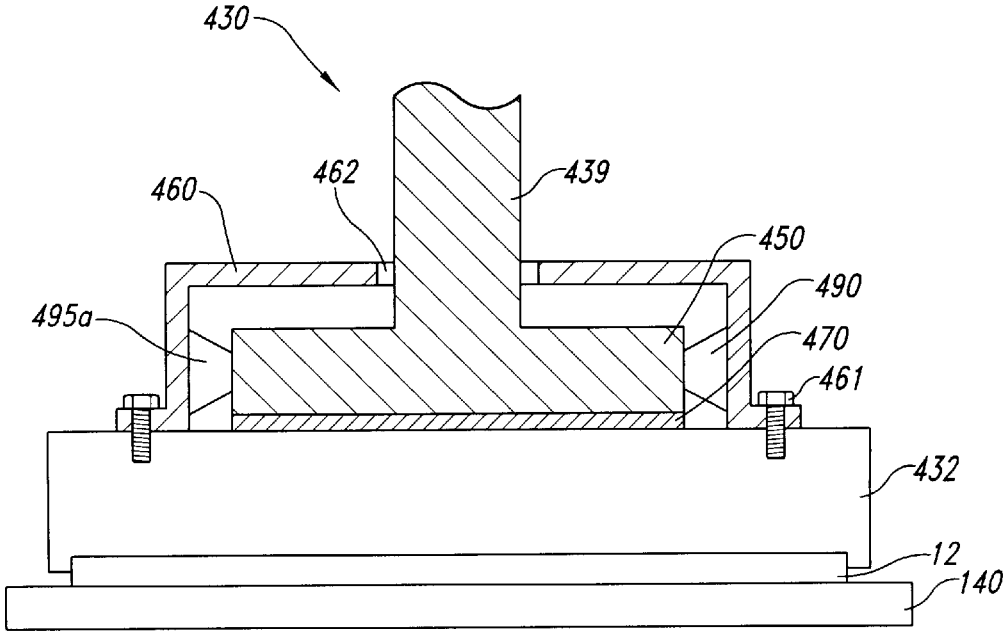
FIG. 11B is a schematic cross-sectional view of the substrate holder of 11A taken along line 11B—11B.

FIG. 11A is a plan view of a carrier assembly 430 for a planarizing machine in accordance with another embodiment of the invention, and FIG. 11B is a schematic cross-section view of the carrier assembly in FIG. 11A along line 11B—11B. The carrier assembly 430 can include a carrier head 32 to hold the substrate assembly 12. A housing 460 is fixedly attached to the carrier head 432 by a number of bolts 461. The carrier assembly 430 also includes a drive shaft 439 extending through a hole 462 in the housing 460, and a drive member 450 at the end of the drive shaft 439 in the housing 460. The drive member 450 engages a low friction pad 470 to press the substrate assembly 12 against the polishing pad 140. The carrier assembly 430 further includes at least one force detector 490 and two dead stops 495*a*/495*b* (FIG. 11A). The force detector 490 and the dead stops 495*a*/495*b* can be equally spaced apart from one another around the interior of the housing 460.

In operation, the drive shaft 439 can be orbited about an eccentric axis as described above with reference to FIG. 1. The drive member 450 presses against the force detector 490 and the dead stops 495*a*/495*b* to move the carrier head 432 and substrate assembly 12 over the polishing pad 140. The force detector 490 accordingly senses drag forces between the substrate assembly 12 and the polishing pad 140.

Figure 12:
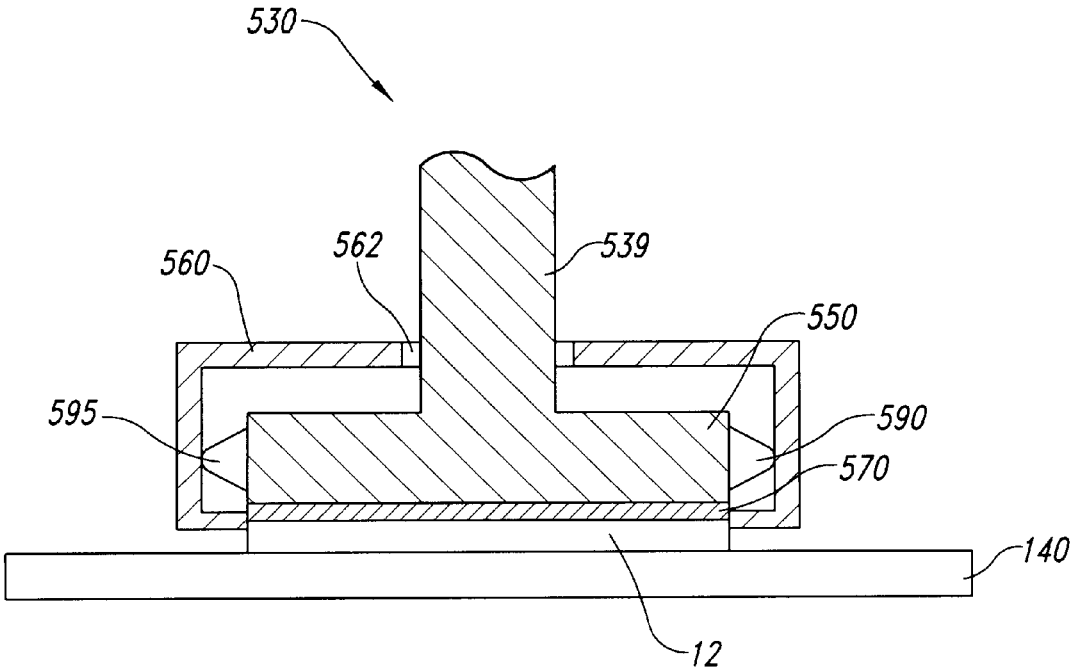
FIG. 12 is a schematic cross-section view of a substrate holder having an endpointing apparatus in accordance with another embodiment of the invention.

FIG. 12 is a schematic cross-sectional view of a carrier assembly 530 for a planarizing machine in accordance with still another embodiment of the invention. The carrier assembly 530 includes a carrier head 532 having a retaining ring 560 with an opening 562. The carrier assembly 530 also includes a drive shaft 539 extending through the opening 562 and a drive member 550 in the carrier head 532. The carrier assembly 530 can have a force detector 590 attached to one portion of the drive member 550 and a number of dead stops 595 attached to other portions of the drive member 550. The force detector 590 and the dead stops 595 can be arranged as set forth above with respect to the carrier assembly 430 in FIG. 11A. The carrier assembly 530 can also include a low friction backing film 570 between the substrate 12 and the drive member 550. In operation, the drive shaft 539 and the drive member 550 push the housing 560 via the force detector 590 and the dead stops 595 to move the substrate assembly 12 across the polishing pad 140. The carrier assembly 530 accordingly detects the lateral forces between the drive member 550 and the housing 560 corresponding to the drag forces between the substrate assembly 12 and the polishing pad 140.

Figure 13:
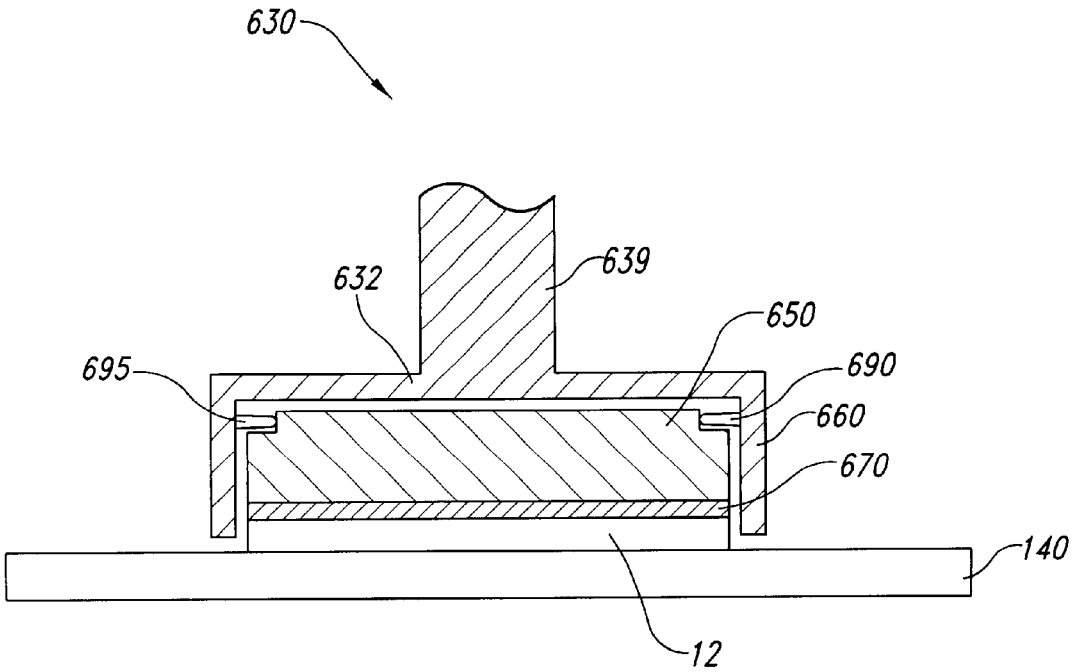
FIG. 13 is a schematic cross-section view of a substrate holder having an endpointing apparatus in accordance with another embodiment of the invention.

FIG. 13 is a schematic cross-section view of another carrier assembly 630 for a planarizing machine in accordance with an embodiment of the invention. In this embodiment, the substrate assembly 630 has a carrier head 632 connected to a drive shaft 639 and a retaining ring 660. A backing member 650 is positioned within the cavity of the carrier head 632. The carrier assembly 630 also includes a force detector 690 attached to one portion of the retaining ring 660 and a number of dead stops 695 attached to other portions of the retaining ring 660. The backing member 650 contacts the force detector 690 and the dead stops 695 so that the lateral movement of the carrier head 632 drives the backing member 650 laterally over the polishing pad 140. A high friction backing member 670 frictionally couples the backing member 650 to the substrate assembly 12. In operation, the carrier head 630 drives the backing member 650 via the force detector 690 and the dead stops 695 to move the substrate assembly 12 laterally across the polishing pad 140. The drag forces between the substrate assembly 12 and the polishing pad 140 are accordingly detected by the force detector 690.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A method of planarizing a microelectronic substrate assembly, comprising:

removing material from the substrate assembly by pressing the substrate assembly against a planarizing surface of a polishing pad and moving at least one of the substrate assembly or the polishing pad in a planarizing plane;

monitoring a lateral drag force between the substrate assembly and the planarizing surface by sensing lateral forces between a moveable primary support member supporting either the polishing pad or the substrate assembly and a secondary support member holding the primary support member; and terminating removal of material from the substrate assembly when the sensed lateral drag force reaches a predetermined endpoint force.

2. The method of claim 1 further comprising providing a low friction bearing assembly between the primary support member and the secondary support member that allows the primary support member to freely move laterally with respect to the secondary support member.

3. The method of claim 1 wherein:

the secondary support member comprises a base of a table of a planarizing machine and the primary support member comprises a primary plate moveably coupled to the base, the base having a base surface facing toward the polishing pad and at least a first stop surface extending from the base surface transverse to the planarizing plane, and the primary plate having a bearing surface facing the backside of the polishing pad to support at least a portion of the polishing pad in a planarizing zone and at least a first contact surface adjacent to the first stop surface; and monitoring the lateral drag force comprises providing at least a first force detector contacting the first stop surface and the first contact surface at a first load site to sense lateral forces between the base and the primary plate and processing electrical signals from the first force detector with a processor to produce data representing the drag force between the substrate assembly and the polishing pad.

4. The method of claim 1 wherein:

the secondary support member comprises a drive shaft of a carrier assembly of a planarizing machine and the primary support member comprises a carrier head pivotally coupled to the drive shaft, the drive shaft having a lower end with a stop surface orientated transverse to the planarizing plane and the carrier head having an upper cavity with a contact surface, the drive shaft being received in the upper cavity to position the stop surface adjacent to the contact surface; and monitoring the lateral drag force comprises providing a force detector contacting the stop surface and the contact surface at a load site to sense lateral forces between the drive shaft and the carrier head and processing electrical signals from the force detector with a processor to produce data representing the drag force between the substrate assembly and the polishing pad.

* * * * *